US005480366A

United States Patent [19]

Harnden et al.

[11] Patent Number: 5,480,366

[45] Date of Patent: Jan. 2, 1996

[54] STATIONARY BICYCLE TRAINER

[76] Inventors: Eric F. Harnden; Leif Harnden, both of 1030 Berne Dr., Crestline, Calif. 92325

[21] Appl. No.: 210,011

[22] Filed: Mar. 17, 1994

[51] Int. Cl.[6] ..... A63B 22/06; A63B 69/16

[52] U.S. Cl. ..... 482/61; 482/57

[58] Field of Search ..... 482/61, 57, 73, 482/903, 60, 58, 63, 64

[56] References Cited

U.S. PATENT DOCUMENTS

| | | | |
|---|---|---|---|
| 734,662 | 7/1903 | Blaisdell . | |
| 747,294 | 12/1903 | Blaisdell . | |
| 2,068,578 | 1/1937 | Stronach | 272/79 |
| 2,835,563 | 3/1958 | Lawton | 272/79 |
| 3,373,992 | 3/1968 | Ludeman | 272/73 |
| 3,494,616 | 2/1970 | Parsons | 272/73 |
| 3,531,113 | 9/1970 | Gibbs | 272/79 |
| 3,758,112 | 9/1973 | Crum et al. | 272/79 |
| 3,979,113 | 9/1976 | Uhl et al. | 272/73 |
| 4,082,264 | 4/1978 | Santos | 272/73 |
| 4,188,030 | 2/1980 | Hooper | 272/73 |
| 4,353,544 | 10/1982 | Wiley | 272/73 |
| 4,463,945 | 8/1984 | Spector | 272/73 |
| 4,509,742 | 4/1985 | Cones | 272/73 |
| 4,576,376 | 3/1986 | Miller | 272/69 |
| 4,579,335 | 4/1986 | Centafanti | 272/69 |
| 4,582,318 | 4/1986 | Giannelli et al. | 272/73 |
| 4,645,199 | 2/1987 | Bloemendaal | 272/73 |
| 4,726,581 | 2/1988 | Chang | 272/70 |
| 4,772,016 | 9/1988 | Manion | 272/130 |
| 4,776,583 | 10/1988 | Jennings | 272/73 |
| 4,789,153 | 12/1988 | Brown | 482/73 |
| 4,976,426 | 12/1990 | Szabo et al. | 272/73 |
| 4,979,735 | 12/1990 | Stewart | 272/130 |
| 4,981,199 | 1/1991 | Tsai | 188/312 |
| 5,016,872 | 5/1991 | Lee | 272/73 |
| 5,026,047 | 6/1991 | Kosecoff | 482/61 |
| 5,112,043 | 5/1992 | Gilfillian, Jr. | 482/53 |
| 5,114,389 | 5/1992 | Brentham | 482/53 |
| 5,129,450 | 7/1992 | Hung | 165/168 |
| 5,139,255 | 8/1992 | Sollami | 482/58 |
| 5,139,470 | 8/1992 | Wang | 482/53 |
| 5,183,453 | 2/1993 | Yamashiro | 482/112 |
| 5,195,936 | 3/1993 | Mao | 482/112 |

FOREIGN PATENT DOCUMENTS

| | | | |
|---|---|---|---|
| 1431785 | 10/1988 | U.S.S.R. | 482/61 |
| 1431786 | 10/1988 | U.S.S.R. | 482/61 |
| 1523155 | 11/1989 | U.S.S.R. | 482/61 |

*Primary Examiner*—Stephen R. Crow
*Attorney, Agent, or Firm*—Poms, Smith, Lande & Rose

[57] ABSTRACT

A stationary bicycle trainer includes a stand for supporting the rear of a conventional chain-drive bicycle in a normal riding position, and a chain-drive resistance device which is especially configured to be received at the rear drop outs of the bicycle between the chain stays and the seat stays of the bicycle frame in substitution for the rear drive wheel and tire assembly.

18 Claims, 2 Drawing Sheets

STATIONARY BICYCLE TRAINER

BACKGROUND OF THE INVENTION

1. Field of the Invention

The present invention is in the field of physical training and exercise devices. More particularly, the present invention is in the field of stationary training devices used by bicyclists to simulate the physical exercise of riding a mobile or traveling bicycle. Still more particularly, the present invention relates to a folding and portable stationary-type of training apparatus for use with a conventional bicycle which will support the stationary bicycle and a rider in an upright position, and which will allow the rider to simulate actual mobile riding of the bicycle while providing resistance to the rider's exertions so that a desired level of physical exercise is obtained by the rider.

2. Related Technology

A conventional stationary bicycle exercise device is known in accord with U.S. Pat. No. 3,979,113, issued 7 Sep. 1976 to Uhl, et al., in which a pair of stands, one for each end of a conventional bicycle, are used to support the bicycle and a rider in an upright position. As so supported, the rear drive wheel of the bicycle is free-turning. The bicycle could be "ridden" in a stationary location to gain exercise. However, in order to increase the pedalling resistance provided by the bicycle, the '113 patent is believed to teach the addition to the bicycle drive wheel of paddles, which are carried on the spokes of the rear drive wheel and increase the turning resistance of this wheel when it is spinning. Accordingly the pedalling resistance experienced by the rider is increased by the paddles on the rear drive wheel catching the air as the wheel spins.

With a bicycle exerciser according to the '113 patent, the user of the device must install both the front and the rear of the bicycle onto the stands, and also must install the paddles on the spokes of the rear wheel. This installation process involves the use of many parts, and is quite time consuming. For example, the '113 patent teaches to attach the rear stand to the bicycle frame using a pair of clamp plates on each of the wheel stays of the frame. These clamp plates are not quick to install, and are equally time consuming to remove. Most bicyclists would not be willing to simply leave the clamp plates on the bicycle when it is being ridden on a road, track, or trail because of their extra weight, and the great premium in high performance bicycling which is placed on light weight. Further, when the exerciser is not in use, the pair of stands is not really convenient to store because each stand takes up considerable space. The paddles must also be removed individually from the bicycle spokes, and provision must be made to store these paddles. Also, some modern high performance bicycles use light weight, fine-dimension wire spokes, which may not well withstand the lateral forces imposed by the paddles of the '113 invention. Some modern bicycles even use composite wheels with as few as three spokes of composite material. These spokes would not be well adapted to accept the air resistance paddles as suggested by the '113 patent.

Another conventional stationary cycle-type of exercise apparatus is known in accord with U.S Pat. No. 3,494,616, issued 10 Feb. 1970 to B. D. Parsons. The '616 patent is believed to teach a stationary cycle-type of exerciser in which a pedal set drives a vane type of hydraulic pump. An outlet of the pump is connected to an adjustable throttling valve. The valve exhausts into a reservoir located at a level above the pump, and from the reservoir hydraulic liquid flows by gravity to the inlet of the vane pump. However, the apparatus of the '616 patent is not usable either with or as part of a conventional bicycle. That is, the device of the '616 patent is merely a stationary cycle-type of exercise device. The exerciser taught by the '616 patent is not a training device for use with a conventional bicycle to simulate travel on the bicycle, and which allows the bicycle to be used in a conventional way for bicycling when it is not in use on a stationary training apparatus.

The conventional technology also includes stationary bicycle exercise devices, which are generally known in the pertinent field as "roller trainers". These roller trainers generally include a frame which rests upon a floor and which carries both a pair of relatively wide and closely spaced rear rollers, and at least one similarly wide front roller. One of the rear rollers is drivingly connected to the front roller so that when a conventional bicycle is placed on the trainer with its rear drive wheel between and driving the two rear rollers and its front wheel resting on and driven by the front roller, a rider may enjoy a stationary but still dynamic bicycle ride. That is, the rider may ride the bicycle on the trainer with the rear drive wheel driving the two rear rollers and the front roller driving the front wheel of the bicycle. In this way, the spinning wheels of the bicycle along with the spinning rollers of the trainer (and also, possibly, a spinning flywheel coupled with these rollers) simulates the inertia and momentum of the bicycle and rider in motion. However, the trainer, the bicycle and the rider actually stay in place and do not travel during such a training "ride".

With a conventional roller trainer, the user must be careful to maintain balance, and to keep the bicycle on the rollers. Otherwise, the rider may crash, and may actually fall from the bicycle. Even though the rider is not actually traveling at all, this type of fall still presents the chance of injury, merely from the fall itself, or from contact with the spinning parts of the bicycle or trainer apparatus. The conventional roller trainer is also generally quite large, heavy, and expensive because of its complexity. This trainer is not easily portable, and requires considerable storage space when not in use.

Another type of conventional bicycle stationary trainer is generally known as the "full size" type of trainer. These trainers generally include a frame which rests upon a floor, and which includes a special clamping device to which the frame of a conventional bicycle is secured by first removing the front wheel. The clamping device takes the place of the front bicycle wheel, and secures the bicycle frame to the trainer so that the rear drive wheel of the bicycle rests upon and drives a roller. A resistance device, such as a magnetic hysteresis device or a fan, is drivingly connected to the roller. Also, many of these devices include a flywheel connected to the roller to simulate the inertia and momentum of actual travel on the bicycle. With a full size trainer, the rider need not maintain balance because the trainer frame supports the rider and bicycle in an upright position. However, these trainers generally require some installation effort and time, both to install the bicycle for use on the trainer and for conversion of the bicycle once again for normal travel off of the trainer. When the full size trainer apparatus is not in use it is not convenient to store because of its weight and size. Again, this type of bicycle trainer is somewhat complex and is also expensive.

Yet another category of bicycle trainer is known as the folding stationary trainer. These devices generally include a folding frame or stand, which in its use configuration secures to the bicycle by clamping to opposite ends of the rear axle. The rear drive wheel is suspended off the underlying support surface, such as the floor, and drives a roller carried on the trainer stand. The roller generally is drivingly connected to a resistance device, and also possibly to a flywheel. The bicycle may be ridden on the folding stationary trainer similarly to use of a full size trainer. The folding stationary trainer stand supports the bicycle and rider in an upright position with no need for the rider to maintain balance.

Because the folding stationary trainers elevate the rear drive wheel of the bicycle, the rider may find the resulting "pitched forward" riding position to be uncomfortable. Some riders of a folding stationary trainer find it desirable to shore up the front wheel of the bicycle in order to compensate for the elevation of the rear wheel, and to maintain a normal riding attitude of the bicycle. When the trainer is not in use, and the bicycle has been removed from the trainer, the folding stationary trainer stand folds to a smaller size for storage. Some of this advantage of a small storage size is lost if the rider must also store blocking or other shoring materials for the front wheel of the bicycle. These folding stationary trainers are generally smaller, lighter, less expensive and easier to store than the roller type or full size type of trainer discussed above. Additional information about several of the conventional folding stationary trainers is provided by an article entitled, "Going Nowhere—A Buyer's Guide to Folding Stationary Trainers", which appeared in *Bicycling* magazine for January 1994 at pages 60–64.

The folding type of stationary bicycle trainer has many advantages, and has been well accepted by the public. However, this type of trainer, and all other trainers which use the rear tire and drive wheel of the bicycle to drive a resistance device, through the use of a friction roller engaging with the tire, for example, suffer from an inescapable shortcoming. This shortcoming is evident when a mountain type of bicycle or a track type of bicycle is used on the trainer. With a mountain type of bicycle, the knobby off-road tread of the rear tire is very noisy and vibrates the bicycle on the roller. As is mentioned by the *Bicycling* article cited above, many users of conventional folding trainers with mountain bicycles have to replace the rear wheel with another wheel mounting a smooth-tread tire. Another drawback of the conventional stationary trainers is apparent with track type bicycles using low-friction, but fragile and expensive, sew-up type of wheels and tires. These wheels and tires provide the optimum performance for track riding. However, the tires are somewhat fragile and do not well endure the rigors of increased distortion and heat created by driving contact with the small radius of a drive roller on a stationary trainer. The user of this type of bicycle must similarly replace the rear drive wheel and tire of the bicycle with another wheel (such as a conventional "clincher rim" wheel) having a more durable smooth-tread tire for training "rides".

SUMMARY OF THE INVENTION

In view of the deficiencies of conventional bicycle stationary trainers, an object for the present invention is to provide a stationary bicycle trainer which will support a bicycle and rider in an upright position for training "rides", and which does not use the rear drive wheel and tire of the bicycle to drive a resistance device or inertia/momentum device of the trainer.

Additionally, an object for the present invention is to provide a stationary bicycle trainer in which a resistance device of the trainer is directly driven by the drive chain of the bicycle.

Still further, another objective for the present invention is to provide such a bicycle stationary trainer in which the rear drive wheel of the bicycle is removed, and the trainer stand and resistance device take the place of the rear drive wheel, and support the bicycle and rider in an upright position for training.

Accordingly the present invention provides a stationary bicycle trainer having a stand for supporting a bicycle and rider in an upright position in substitution for the rear wheel and tire of the bicycle. The stand also carries a device for providing resistance, or resistance and inertia/momentum, or just for providing inertia/momentum, as will be explained, and which is directly coupled to the drive chain of the bicycle. The trainer is foldable for convenient storage when not in use. Also, the trainer is small and may be made light enough to be easily portable.

An advantage of the present stationary bicycle trainer resides in its completely avoiding use of the rear drive wheel and tire of the bicycle for driving a resistance device of the trainer. Because the rear drive wheel and tire of the bicycle is not used at all by the trainer, the rear tire of the bicycle in not at all worn or damaged by training use of the bicycle on the trainer. This is in contrast to conventional full size and folding stationary trainers which can damage the rear tire of the bicycle. Such is the case also, of course with respect to the front wheel of the bicycle, which remains stationary during training use of the bicycle on the stationary trainer. This is in contrast to the conventional roller trainers, which can damage the rear tire, and also the front tire of a bicycle. Also, mountain bikes, with their knobby off-road tires having unacceptably loud and vibrational tread patterns when used on a conventional roller-drive type of bicycle trainer, can be used on the present trainer with no additional noise or vibration being generated. Track type bicycles with their fragile and expensive sew-up type of wheels and tires similarly can be used on the present stationary trainer without damage to the rear wheel and tire set. In each case the bicycle owner need not purchase and install on the bicycle for training use a more quiet or more durable wheel and tire assembly. The present trainer uses merely the drive chain of the bicycle to drive a resistance device directly, and does not use the bicycle rear wheel and tire.

Additional objects and advantages of the present invention will be apparent from a reading of the following detailed description of a single exemplary preferred embodiment of the present invention, taken in conjunction with the appended drawing Figures, in which the same reference numeral refers to the same feature throughout the several views or to features which are analogous in structure or function to one another.

DESCRIPTION OF THE DRAWING FIGURES

FIG. 1 provides a side elevation view of a conventional bicycle as it would appear while resting or in motion in an upright position, and with a stationary trainer of the present invention shown in phantom at the rear of the bicycle;

FIG. 2 is a fragmentary rear perspective view of the bicycle seen in FIG. 1 with its rear wheel and tire assembly removed and the bicycle installed on a stationary trainer stand embodying the present invention;

FIG. 3 provides a rear elevation view taken generally at the plane indicated with the numerals 3—3 of FIG. 2, and looking in the direction of the arrows; and FIG. 4 is a fragmentary top or plan view of a stand portion of the stationary bicycle trainer of the present invention, which is shown with the bicycle and parts of the trainer removed for clarity of illustration; and FIG. 5 provides a rear perspective view of the stationary training stand of the present invention in its folded configuration, which is taken generally from the same vantage point as that of FIG. 2, but without the bicycle and resistance device portion of the trainer.

DETAILED DESCRIPTION OF AN EXEMPLARY PREFERRED EMBODIMENT OF THE INVENTION

Figure 1:
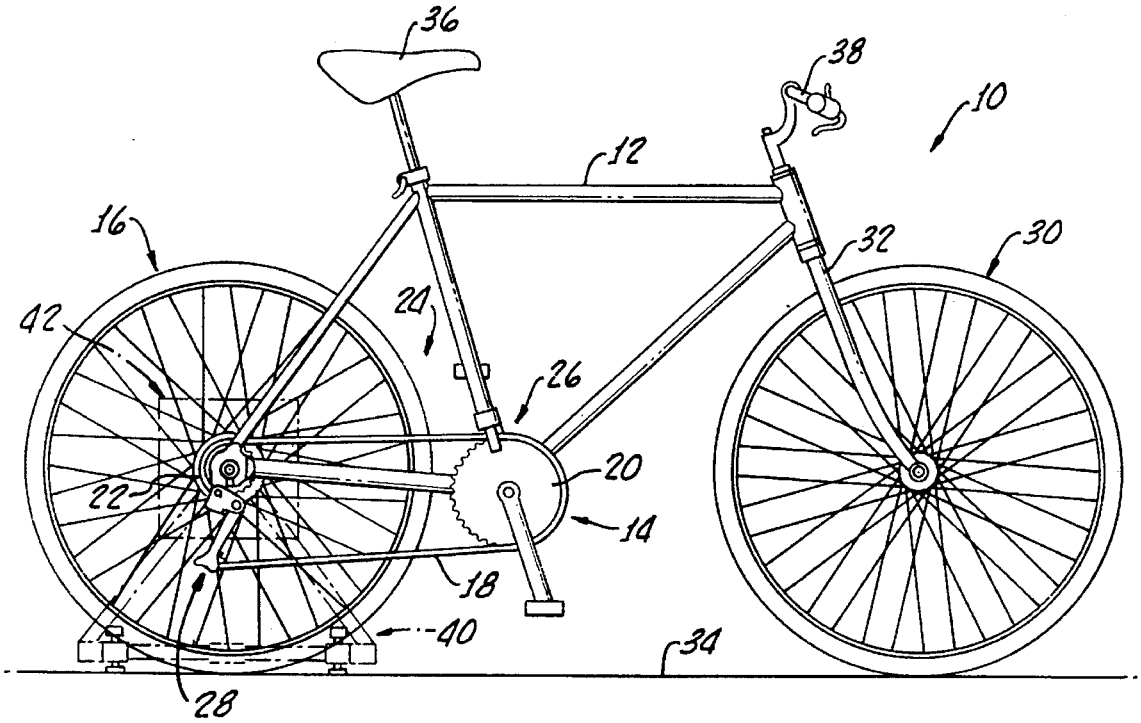

Viewing first FIG. 1, a conventional bicycle 10 is shown in side elevation view for purposes of foundational illustration. The bicycle 10 includes a conventional frame 12 of diamond-frame design, although the present invention is equally usable with bicycles of other frame designs. Although the diamond-frame design of the bicycle 10 might at one time have been referred to as a "man's" bicycle, both sexes generally ride the diamond-frame design of bicycle in current high performance bicycling. On the other hand, the present stationary trainer apparatus can be equally used with bicycles of all frame designs, including the mixte-frame design, as well as with bicycles having other types of "ladies-bicycle" frame designs. The present stationary trainer apparatus also is equally usable with various mountain-type and track-type of bicycles, including those mountain bicycles which include various types of suspension systems.

Importantly, the bicycle 10 includes a crank set 14 which is rotationally carried by the frame 12; a rear drive wheel and tire assembly 16, which is also carried by the frame 12; and a drive chain 18 drivingly connecting a chain ring 20 of the crank set 14 with a drive cog 22 of the rear wheel and tire assembly 16. The bicycle 10 is of the 10-speed (or multi-speed) type, which includes two or more chain wheels (each of a different size) carried by the crank set 14, and a cluster of drive cogs (also each of different size) carried by the rear wheel and tire assembly 16. Generally, the cluster of drive cogs will include 5 or more cogs of differing sizes, although certain bicycles, such as track bicycles will have only a single drive cog at the rear drive wheel and tire assembly. A derailleur apparatus, generally referenced with the numeral 24 includes a front derailleur portion 26 for shifting the drive chain 18 to a selected one of the chain wheels, and a rear derailleur portion 28 for shifting the drive chain to a selected one of the rear drive cogs. Accordingly, the combination of the various sizes of the front chain rings and of the drive cogs of differing sizes in the rear cluster provides the bicycle 10 with a multitude of different "speeds" or different effective gear ratios between the crank set 14 and rear wheel and tire assembly 16.

However, it should be kept in mind that the present stationary trainer can be used with any bicycle having a chain drive between its crank set and rear drive wheel. That is, the present trainer may be used with track bicycles, which are a single speed bicycle; and also with the conventional "English", or other type of multi-speed bicycles which have a gear-change hub at the rear wheel and tire assembly. These gear change hubs generally include internal planetary gear sets and dog-type clutches which allow selection by the rider among two or more different effective gear ratios between the crank set and rear drive wheel and tire assembly. All of these chain-drive bicycle types, and others, may be used equally with the stationary trainer of the present invention.

Viewing FIG. 1 again, it is seen that the bicycle 10 includes a front wheel and tire assembly 30, which is carried pivotally with respect to the remainder of the bicycle 10 by a front fork assembly 32. With both of the front and rear wheel and tire assemblies 16 and 30 resting on a supporting surface 34, such as a floor, road surface, or the earth, the bicycle 10 has a normal riding position. In this normal riding position, the rider will adjust the relative positions of the seat 36, and handle bars 38, both with respect to one another, but also in relation to the position of the crank set 14, in order to best fit the preferences and anatomy of the rider. Thus, the adjustments and normal riding position of a bicycle is very much of a personal and highly discretionary matter with bicyclists. At FIG. 1, a stationary trainer, generally referenced with the numeral 40 is shown in phantom. As will be seen, when the bicycle 10 is installed on the trainer 40 for use in a training "ride" or session, the normal riding position of the bicycle 10 is preserved.

Figure 2:
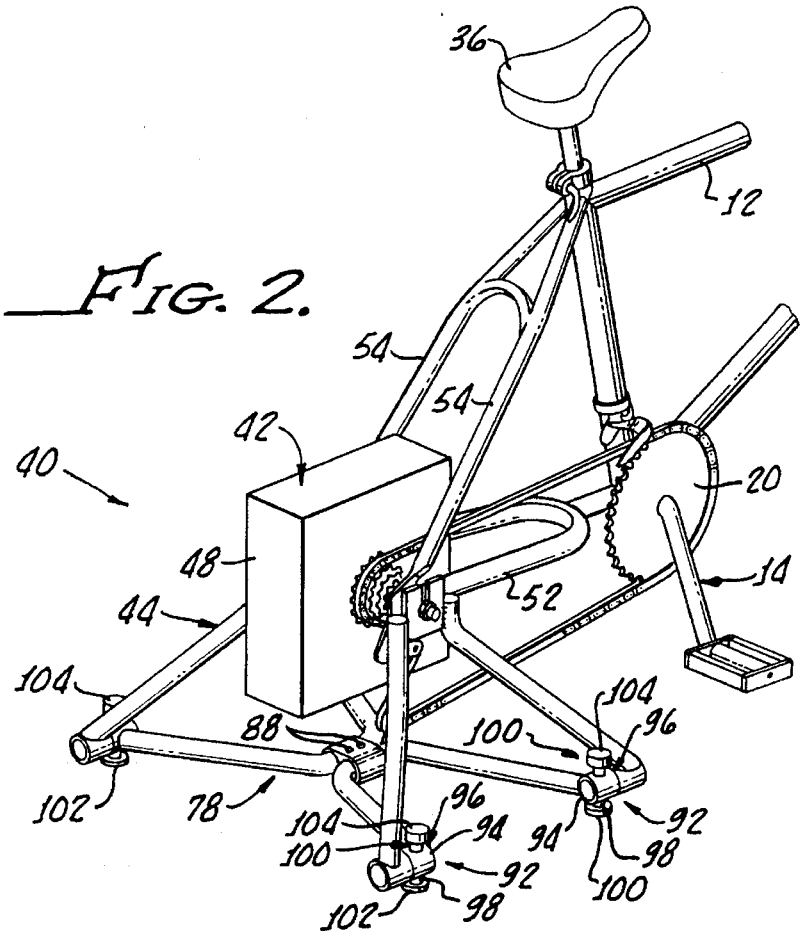
Figure 3:
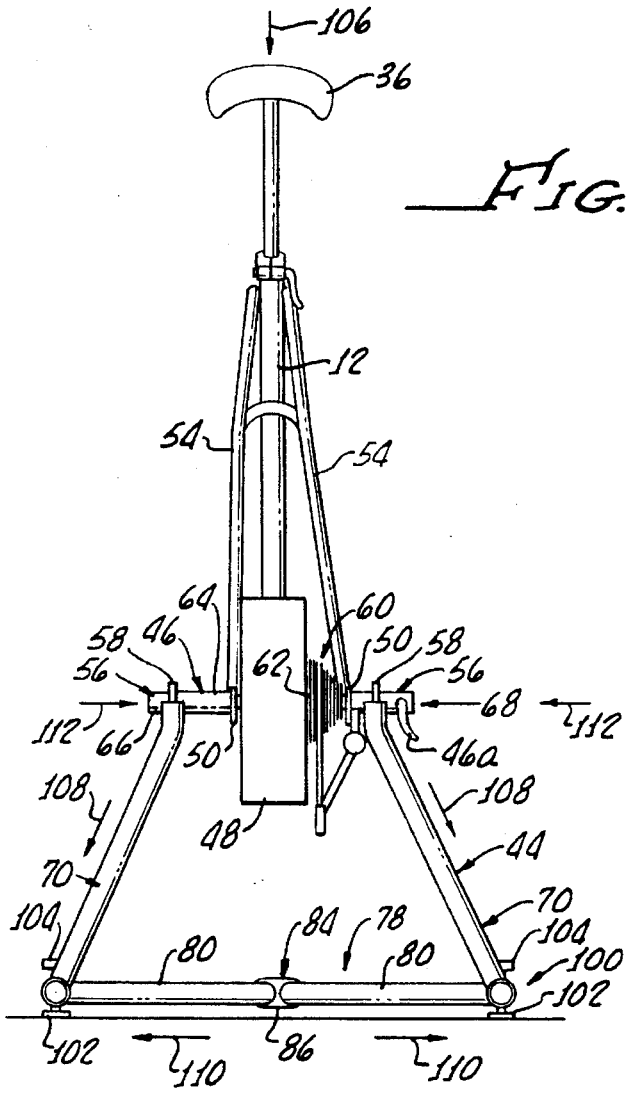

Viewing now FIGS. 2 and 3 in conjunction with FIG. 1, it is seen that the stationary trainer apparatus 40 includes both a resistance device portion 42, and a somewhat pyramid-shaped support stand portion 44. As the bicycle 10 is installed on the trainer 40, the rear wheel and tire assembly 16 of the bicycle (as well as the drive cog cluster of this rear wheel and tire assembly) have been removed by the user, and replaced with the trainer 40. The resistance device portion 42 includes a clamping shaft assembly 46, which is made like a longer version of the quick-release axle shaft assembly normally used at the rear wheel and tire assembly 16, and which centrally carries the housing portion 48 of the resistance device 42. The clamping shaft device 46 clamps the resistance device 42 to the rear wheel dropouts 50. These dropouts 50 are respectively located on each side of the frame 12 at the intersection of the chain stays 52 and seat stays 54 of the bicycle frame. At opposite outer portions 56, the clamping shaft assembly 46 projects outwardly on each side of these drop outs 50, and supportingly clamps also to a pair of upper bracket portions 58 of the support stand portion 44.

The resistance device 42 includes a rotational cluster 60 of drive cogs, which cluster 60 is functionally equivalent to the drive cog cluster of the rear wheel and tire assembly 16 of the bicycle 10. Accordingly, it is seen that the drive chain 18 of the bicycle 10 drivingly engages one of the drive cogs of the cluster 60. Also, the rear derailleur 28 of the bicycle 10 is co-operable with the cluster 60 to select any one of the several differently sized drive cogs in the cluster in order to provide a selected effective gear ratio between the crank set 14 of the bicycle 10 and the resistance device 42 according to the preference of the rider. The drive cog cluster 60 is carried by and drives an annular drive shaft, indicated with the arrow 62, which extends into the housing 48, to drive the resistance device 42. It should be understood that the resistance device 42 may include as few as one drive cog. This would be especially the case with a resistance device which is made for use on a track bike. Track bikes have only a single gear ratio, and also do not include either a front or rear free-wheel device. In other words, the pedals are positively connected drivingly to the rear wheel and tire assembly of a track bike, with no over running or ratcheting device to allow the bicycle to coast while the pedals do not turn.

As those who are ordinarily skilled in the pertinent arts will well understand, the resistance device 42 may include a number of different devices which are effective to provide resistance and work absorption for the rider of the bicycle 10 while on the trainer 40. For example, the resistance device 42 may include a fan, or a magnetic hysteresis device.. Alternatively, the device 42 may include a variably-valved or variably-throttled hydraulic resistance device similar to that taught by the '616 patent discussed above. The resistance device 42 may also include a flywheel so that the inertia and momentum of actual travel on the bicycle 10 is simulated by the trainer 40. In this case, the resistance device 42 would actually be a resistance and inertia/momentum device. Still alternatively, the resistance device 42 may include only a flywheel to provide only inertia and momentum, but without any device or mechanism to provide resistance or work absorption. This type of resistance device which provides only inertia/momentum would be especially appropriate for training use by track bike riders because the rider's ability to produce an explosive burst of acceleration against the inertia represented by the total mass of the rider and the bicycle into a sprint is so important to success in track racing. In view of the above, it is seen that through out this application, the term "resistance device" is used to denote a device which mechanically may provide resistive energy dissipation, inertia/momentum, or both resistance and inertia/momentum.

Returning to a consideration of FIGS. 2 and 3, it is seen that the outer portions 56 of the clamping shaft assembly 46 each include a spacer 64 which is interposed between the respective dropout 50 and the adjacent one of the upper brackets 58. These spacers 64 are tubular and are movably carried on the clamping shaft assembly 46 between the dropouts 50 and a head 66 at one end of the clamping shaft assembly 46 at one end thereof, and an adjustable over-center type of clamp 68 threadably carried on a central stem (not visible in the drawing Figures) of the clamping shaft assembly 46. Many features of this clamping shaft assembly will be familiar to those skilled in the bicycle arts because they are adapted from and are intended to provide the same function as a quick release type of axle assembly of a bicycle wheel. After placing the resistance device 42 in the dropouts 50, and placing the end portions 56 in the respective brackets 58, the user of the trainer 40 clamps these elements solidly to one another by forcing a handle 68*a* of the clamp over center. Regardless of whether the bicycle 10 uses quick release axles, after the rear drive wheel and tire assembly 16 has been removed from the frame 12, the clamping shaft assembly 46 can be used to quickly secure and to quickly release the resistance device 42 and the stand 44 at the dropouts 50.

Also viewing FIGS. 2 and 3, it is seen that the stand 44 includes a pair of generally triangular side frames 70. The side frames 70 may preferably be identical to one another, as is depicted, and each defines a respective one of the brackets 58 at an upper apex of two side tubes 72. The brackets 58 are defined by a plate part 74, which is connected (by welding, for example) between the pair of side tubes 72. The side tubes 72 are not otherwise connected to one another. However, each of the side tubes 72 at a lower end thereof is connected to a short length 76 of round tubing. These short lengths 76 of round tubing are parallel to one another so that they may cooperatively form elements of a hinge, as will be explained.

Figure 4:
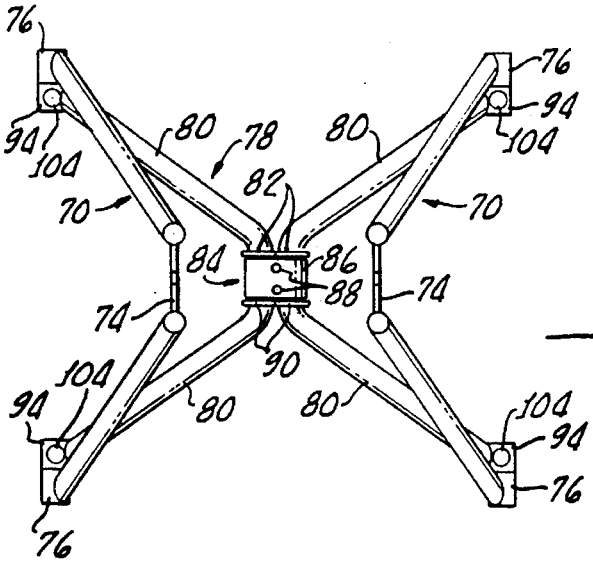

Extending generally horizontally between the pair of side frames 70, and hinged to each as will be more fully explained, is a folding bottom frame, generally referenced with the numeral 78. As is best seen viewing FIGS. 3 and 4, the bottom frame 78 includes two essentially identical V-shaped tubing pieces 80, which are hinged to one another. The tubing pieces 80 are hinged to one another by pivotal passage of each tubing piece at an essentially straight center section 82 of each through a split clamp 84. The split clamp 84 includes a pair of identical bodies 86. These bodies 86 may be cast of metal such as aluminum, for example; or may be cast of an engineering polymer material, such as fiber reinforced plastic (FRP). The bodies 86 define a pair of spaced apart parallel semi-cylindrical grooves (not visible in the drawing Figures), cooperatively defining a cylindrical bore for receiving one of the center sections 82 of a respective tube 80. Each of the grooves, and the cylindrical bores cooperatively defined by the aligned grooves, receives one of the straight center sections 82 of one of the tubes 80. The bodies 86 are then fastened to one another by plural fasteners, generally indicated with the numeral 88, passing through aligning holes of the identical bodies 86, Thus, the bodies 86 pivotally trap the center sections 82 of the tubes 80. Adjacent to the clamp 84, the tubes 80 carry collars 90, which may be secured to these tubes by welding, for example, and which prevent the clamp 84 from moving along the tubes 80. At their outer ends, the tubes 80 each carry and have secured thereto (as by welding) a pair of hinge/foot assemblies 92. Each hinge/foot assembly 92 includes both a short pintle pin portion (not visible in the drawing Figures), and a boss 94 which defines a threaded bore (not visible in the drawing Figures, but generally indicated with the arrow 96). The pintle pin portion of each hinge/foot assembly 92 is pivotally received into the respective short length of tubing 76 at a lower end of one of the side tubes 72 of one side frame 70. Into each bore 96 of each boss 94 is threadably received the threaded stem portion 98 of an adjustable foot member 100. At its lower end, each foot member 100 carries a resilient and high-friction cushion member 102. For example, the cushion members 102 may be formed of natural or synthetic rubber to give good traction on indoor floors while still well enduring use of the trainer 40 outdoors, such as on pavement. At an upper end of each stem 98, each foot member carries a contoured hand knob 104 by which vertical adjustment of the stand 44 may be effected.

Viewing FIG. 3, it is seen that when the rider applies weight to the bicycle frame 12, as is indicated by the arrow 106, this weight is transferred to the support surface 34 along the outwardly angled side frames 70, as is indicated by arrows 108. Of course, at the support surface 70, the supporting force is vertical. The result is that the forces 108 have an unbalanced horizontal component, represented by arrows 110, viewing FIG. 3. The forces 110 place the bottom frame 78 in tension. Consequently, the bottom frame 78 is placed in tension by the rider's weight so that the hinge defined at clamp 84 is maintained in a straight line condition between the hinge/foot assembles 94. Also, the side frames 70 are leaned inwardly toward the dropouts 50 of the bicycle frame 12 as seen in the rear elevation view of FIG. 3 so that the stand 44 and bicycle frame 12 together form a stable and rigid structure. This support from stand 44 to bicycle frame 12 will support the bicycle and its rider in an upright position even during vigorous training "rides".

Having observed the structure of the trainer 40, and part of its use, attention may now be turned more fully to installation of the bicycle 10 on the trainer 40. As was mentioned earlier, the bicyclist first removes the rear drive wheel and tire assembly 16 from the bicycle 10. The bicyclist then places the resistance device 42 between the dropouts 50 with the drive chain looped about the drive cog cluster 60, and with the clamp shaft 46 in the notches of the dropouts 50 where the usual axle for the wheel and tire assembly 16 would be received. This location of the resistance device 42 positions the cluster 60 so that the rear derailleur 28 can be used to change gears on the resistance device 42 just as it would for normal riding of the bicycle 10. Next, the bicyclist rests the rear of the bicycle on the stand 44 by placing the clamp shaft 46 in the brackets 58. As so positioned, the bicyclist secures the bicycle to the stand 44 by manipulating the lever 46*a* over center, thus applying an axial clamping force (indicated with arrow 112, viewing FIG. 3) on the clamp shaft 46. This clamping force keeps the resistance device 42 from rotating relative to the bicycle 10 and stand 44. When the bicyclist first mounts the bicycle 10 on stand 44, there permissively may be a very small amount of relative movement as the cyclist's weight causes the stand to place the bottom frame 78 in tension, and as the "lean in" of the side frames 70 cooperates with the clamping force 112 to solidify the connection of the stand 44 with bicycle frame 12 and with the support surface 34. However, the bicyclist may thereafter vigorously ride the bicycle 10 with the stand 44 providing a solid support for both the bicycle and rider.

Importantly, in using the trainer 40, the bicyclist may adjust the vertical positions of the feet 100 by rotation of the knobs 104 to maintain a normal (rather than pitched forward) riding position. Also, the angulated tubes 72 of the side frames 70 provide additional clearance for the passage of the bicyclist's heal during rotation of the crank set 14, viewing FIG. 1 again. When the training ride is finished, the bicyclist removes the bicycle from the trainer, and reinstalls the rear drive wheel and tire assembly 16. Additionally, as in indicated in FIG. 5, the stand 44 may be folded to a comparatively small size for storage along with the resistance device 42. In other words, the bicyclist may fold the stand 44 by doubling the bottom frame 78 on itself at the hinge defined at clamp 84. Additionally, the hinge/foot assemblies 92 pivot relative to the tubing sections 76 to allow the side frames 70 to fold along side of the respective connected parts of the bottom frame 78.

Figure 5:
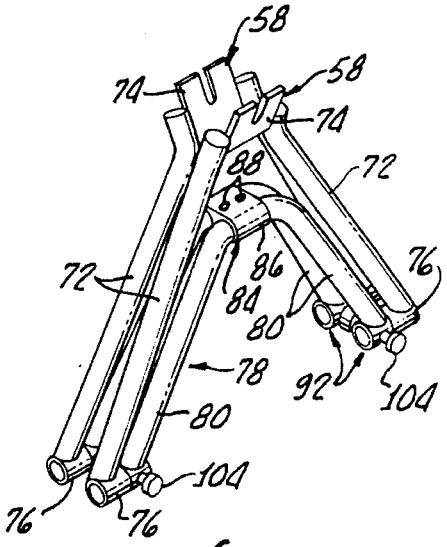

It should be noted that should use of the stand 44 show that it is desirable for stability reasons to lock in position the clamp 84 and/or the hinge/foot assemblies 94 relative to the tubing sections 76 during use of the stand 44, such can be done without affecting the ability of the stand 44 to be folded as depicted in FIG. 5. Also, it may be desirable to limit the extent of outward pivoting movement available between the tubing sections 76 and the hinge/foot assemblies, such as by providing bosses on each of these elements which contact one another when the stand is placed in its use configuration as seen in FIG. 2. This expedient also may be implemented without compromising the folding of the stand 44.

While the present invention has been depicted, described, and is defined by reference to a particularly preferred embodiment of the invention, such reference does not imply a limitation on the invention, and no such limitation is to be inferred. The invention is capable of considerable modification, alteration, and equivalents in form and function, as will occur to those ordinarily skilled in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

We claim:

1. A bicycle trainer apparatus for use with a chain-drive bicycle; said trainer apparatus including rear support stand means for supporting a rear end of said bicycle in a substantially normal riding position, and a chain-drive resistance device carried by said stand means to be driven by the drive chain of said bicycle in substitution for the rear drive wheel and tire assembly of the bicycle, said resistance device including a clamping clamping shaft shaft configured to be accepted into rear wheel drop outs of said bicycle, said resistance device further including a drive cog carried by an annular shaft coaxial with said clamping shaft assembly to be drivingly engaged by said drive chain, said resistance device including a housing portion supported between the rear wheel drop outs of said bicycle by said clamping shaft assembly and drivingly receiving power from said annular shaft.

2. The bicycle trainer apparatus of claim 1 wherein said stand is adjustable for height to allow its use with bicycles having differing sizes of frames and rear wheel and tire assemblies while still allowing a normal riding position in each case.

3. The bicycle trainer apparatus of claim 1 wherein said chain-drive resistance device is configured to be accepted into the frame of said bicycle in substitution for said rear drive wheel and tire assembly of said bicycle.

4. The bicycle trainer apparatus of claim 3 wherein said chain-drive resistance device includes a drive cog to be engaged by the drive chain of said bicycle.

5. A chain-drive resistance device for use in conjunction with a conventional chain-drive bicycle having a crank set, a rear drive wheel and tire assembly carried at drop outs of a frame of said bicycle, and a drive chain connecting a chain ring of the crank set to a drive cog of the rear drive wheel and tire assembly; said resistance device being for use by a bicyclist in substitution for the rear drive wheel and tire assembly of the bicycle to obtain stationary training on said bicycle which is replicative of actual travel on the bicycle; said chain-drive resistance device comprising;

a clamping shaft assembly for carrying said resistance device at said drop outs of said bicycle frame;

a housing for said resistance device carried centrally on said clamping shaft assembly to be disposed between the chain stays and seat stays of said bicycle in substitution for the rear drive wheel and tire assembly of the bicycle;

said resistance device further including at least one drive cog configured to be located at substantially the same location relative to said bicycle frame as said drive cog of said rear drive wheel and tire assembly, and to be driven by the drive chain of said bicycle.

6. A bicycle trainer apparatus for use with a bicycle having a normal riding position and a frame which carries: a crank set, a rear drive wheel and tire assembly, and a drive chain connecting a chain wheel of the crank set to a drive cog of the rear wheel and tire assembly; said trainer apparatus comprising:

a stand configured to rest upon a support surface at the location of and in place of said rear wheel and tire assembly to support said bicycle and a rider in said normal riding position;

said stand carrying a resistance device having a rotational input shaft and drive cog to be driven by said drive chain;

wherein said resistance device includes a clamping shaft configured to be accepted into rear wheel dropouts of said bicycle frame, said clamping shaft supportingly engaging said rear wheel drop outs and supporting said resistance device between said rear wheel drop outs, whereby said resistance device replaces said rear wheel and tire assembly between said rear wheel drop outs of said bicycle.

7. The bicycle trainer apparatus of claim 6 wherein said clamping shaft assembly includes a pair of oppositely extending end portions, and said stand includes a pair of upper bracket portions configured to supportingly receive said end portions of said clamping shaft assembly.

8. The bicycle trainer apparatus of claim 7 wherein said clamping shaft assembly end portions each carry a respective tubular space to be interposed between a respective one of said bicycle dropouts and a respective one of the upper bracket portions of said stand.

9. The bicycle trainer apparatus of claim 8 wherein said clamping shaft assembly is configured as a quick release shaft with an over-center clamp at one end thereof.

10. The bicycle trainer apparatus of claim 6 wherein said resistance device includes at least one of an energy dissipation device, and an inertia/momentum device.

11. The bicycle trainer apparatus of claim 10 wherein said inertia/momentum device includes a flywheel.

12. The bicycle trainer apparatus of claim 10 wherein said stand is foldable.

13. The bicycle trainer apparatus of claim 12 wherein said stand is generally pyramid-shaped.

14. A bicycle trainer apparatus for use with a bicycle having a normal riding position and a frame which carries: a crank set, a rear drive wheel and tire assembly, and a drive chain connecting a chain wheel of the crank set to a drive cog of the rear wheel and tire assembly; said trainer apparatus comprising:

a stand configured to rest upon a support surface at the location of and in place of said rear wheel and tire assembly to support said bicycle and a rider in said normal riding position;

said stand carrying a resistance device having a rotational input shaft and drive cog to be driven by said drive chain;

wherein said stand is foldable;

wherein said stand is generally pyramid-shaped;

wherein said pyramid-shaped stand includes a pair of side frames of generally triangular configuration, and a bottom frame connecting said side frames to one another;

wherein said bottom frame is hingably connected at each side to one of said pair of side frames, and said bottom frame is hingable on itself to fold in half.

15. The bicycle trainer apparatus of claim 14 wherein said bottom frame includes a pair of generally V-shaped members each having a substantially straight center section, and a clamp body embracing each generally V-shaped member at said generally straight center section thereof to hingably connect said members.

16. The bicycle trainer apparatus of claim 15 wherein each of said pair of generally V-shaped members each carry at opposite ends thereof one of four hinge/foot assemblies of said stand, each hinge/foot assembly including a pintle pin and a threaded boss portion which threadably accepts the stem portion of a foot member, each foot member having a lower cushion part for resting upon said support surface and means for allowing manual height adjustment of said stand by rotation of said threaded stem of said foot portion relative to the respective hinge/foot assembly.

17. The bicycle trainer apparatus of claim 16 wherein each of said pair of side frames includes an upper bracket portion for supportingly engaging said resistance device, and a pair of aligned lower tubular features each pivotally receiving a respective pintle pin of one of a pair of the hinge/foot assemblies carried by one of said V-shaped members of said bottom frame.

18. The bicycle trainer apparatus of claim 14 wherein at least the one side of each of said pair of generally triangular side frames which is adjacent to said crank set of said bicycle is angulated to be spaced away from the crank set, thereby to allow greater clearance for the riders foot and heel as the crank set rotates.

* * * * *